US005270727A

United States Patent [19]

Yamamoto et al.

[11] Patent Number: 5,270,727

[45] Date of Patent: Dec. 14, 1993

[54] METHOD FOR IMAGE FORMATION

[75] Inventors: Kyonosuke Yamamoto; Kazuo Yokoyama, both of Tsukuba, Japan

[73] Assignee: Mitsubishi Paper Mills Limited, Tokyo, Japan

[21] Appl. No.: 665,030

[22] Filed: Mar. 6, 1991

[30] Foreign Application Priority Data

Mar. 13, 1990 [JP] Japan ..... 2-062311

[51] Int. Cl.[5] ..... B41J 2/435

[52] U.S. Cl. ..... 346/1.1; 346/76 L; 503/201

[58] Field of Search ..... 346/1.1, 76 L; 503/201; 204/157.15, 157.4, 157.41, 157.6, 157.61

[56] References Cited

U.S. PATENT DOCUMENTS 4,383,261 5/1983 Goldberg ..... 346/1.1
4,821,113 4/1989 McQuade et al. ..... 358/75

FOREIGN PATENT DOCUMENTS 3248804 11/1983 Fed. Rep. of Germany .
2055218 2/1981 United Kingdom .

*Primary Examiner*—Benjamin R. Fuller
*Assistant Examiner*—David Yockey
*Attorney, Agent, or Firm*—Cushman, Darby & Cushman

[57] ABSTRACT

A method for forming an image on a dye. The dye absorbing visible light of a first wavelength, but not visible light of a second wavelength. The dye is decolorized when visible light of the first and second wavelength irradiate the dye simultaneously. Decolorization will be effected only if visible light of the first wavelength and visible light of the second wavelength are simultaneously applied. The method utilizes lasers as the source of the visible light of the first and second wavelengths; thus insuring formation of high resolution images.

11 Claims, 3 Drawing Sheets

METHOD FOR IMAGE FORMATION

BACKGROUND OF THE INVENTION

The present invention relates to a method for formation of visible images by laser beam.

Recently, the technique of subjecting an image information to digital image processing and then processing the resulting digital information into a desired image by computer, etc. has been developed and this technique has been employed in many fields. In this case, it is important to obtain a visual image as a hard copy of final output.

For obtaining the hard copy, it has been found that a laser provides images of high resolution. Current examples of the technique/method in use are a laser image setter and a laser beam printer used in desk top publishing. According to these methods, images are produced by modulating a laser beam by digital image information and subjecting a photosensitive material to scanning exposure with this modulated laser beam.

Since a silver salt photosensitive material is mainly used as a medium for image recording in a laser image setter, the photosensitive material cannot be exposed to roomlight before laser exposing and must be handled in a darkroom. Another disadvantage is that the photosensitive material must be subjected to wet development treatment after the laser exposing. In the laser beam printer, images are formed by an electrophotographic method and hence, it has the disadvantages that complicated development and fixing mechanisms are necessary after laser exposing.

SUMMARY OF THE INVENTION

The object of the present invention is to provide a method for forming an image on photosensitive material using a laser beam. The method allows for the photosensitive material to be exposed to roomlight, etc. before exposure by the with laser beam. Furthermore, processing or processing within a dark room is not required after laser exposure.

The above object has been attained by a method which comprises simultaneously irradiating a dye which absorbs a visible light with the first laser beam which is emitted at the wavelength which the dye absorbs and the second laser beam which is emitted at the wavelength which the dye does not absorb, whereby the dye is decolorized.

DESCRIPTION OF THE INVENTION

Figure 1A:
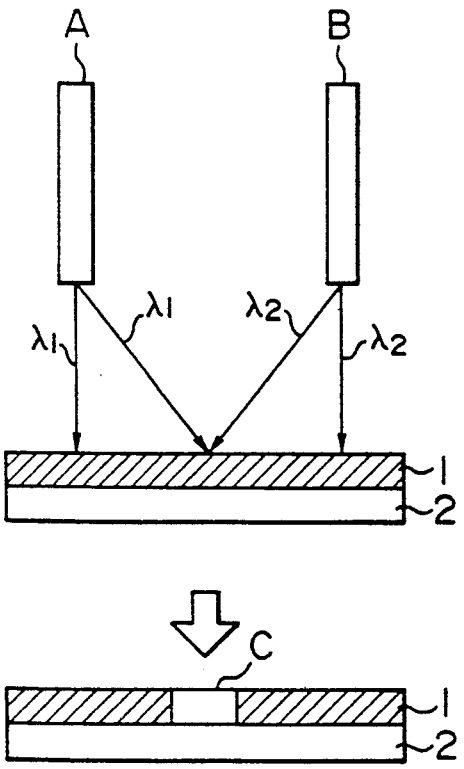
FIG. 1*a* diagrammatically shows decolorization of a dye layer wherein A indicates the first laser, B indicates the second laser and C indicates a decolorized area.
Figure 1B:
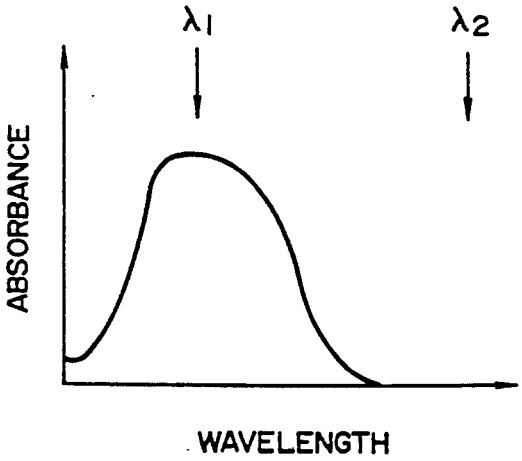
FIG. 1*b* diagrammatically shows the relationship between absorption spectrum of the dye used, wavelength $\lambda_1$ of the first laser beam and wavelength $\lambda_2$ of the second laser beam.

The present invention will be explained referring to the drawings. FIG. 1*a* shows the method for formation of images according to the present invention and FIG. 1*b* diagrammatically shows the relationship between absorption spectrum of the dye used, wavelength $\lambda_1$ of the first laser beam, and wavelength $\lambda_2$ of the second laser beam. When dye layer 1 provided on support 2 is irradiated with either one of the first laser beam which is emitted at wavelength $\lambda_1$ which the dye absorbs or the second laser beam which is emitted at wavelength $\lambda_2$ which the dye does not absorb, the dye shows no change and there is no distinction between the irradiated portion and unirradiated portion. However, when the dye layer is simultaneously irradiated with both the laser beams, a chemical reaction is induced to cause decoloration of the dye clearly, there is a distinction between the irradiated and unirradiated portions and thus, two-dimensional image formation can be attained by scanning exposure or the like. In this case, modulation of the laser beam by digital image formation may be applied to either one of the first laser beam and the second laser beam, and one of the first laser beam and second laser beam; may be continuously irradiated without modulation.

In this way, according to the image formation method of the present invention, the dye is decolored only when the two laser beams of high energy density are simultaneously irradiated and so, the dye layer can be exposed to roomlight, sunlight and the like at any time before, during and after the irradiation with the laser beams.

Moreover, since images are formed by decolorization of the dye only by laser beams, no treatments are required after irradiation with the laser beams. Further, the dye can be decolorized at the molecular level, thus utilizing the merits of high resolution possessed by lasers.

As the support used in the present invention, various materials can be used depending on the uses. For example, in the case of images to be seen by reflected light, plain paper, coated paper, plastic film incorporated with pigment to enhance reflectance, and the like are used. In the case of images to be seen by transmitted light, transparent plastic film, glass plate, and the like are used.

The first laser used in the present invention may be selected in accordance with the absorption wavelength of the dye used and includes, for example, a blue laser such as He-Cd laser (441.6 nm), $Ar^+$ laser (488.0 nm) and He-Ne laser (442.0 nm) for yellow dyes, a green laser such as $Ar^+$ laser (514.5 nm), He-Ne laser (543.5 nm) and second harmonic of YAG laser (532.0 nm) for magenta dyes, and He-Ne laser (632.8 nm) and semiconductor laser (680 nm) for cyan dyes. As the second laser, there may be selected those lasers which emit the wavelength which is not absorbed by the dye used and infrared semiconductor lasers (780 nm, 830 nm and the like).

EXAMPLE

Next, a specific example of the image formation method of the present invention will be shown.

Figure 2:
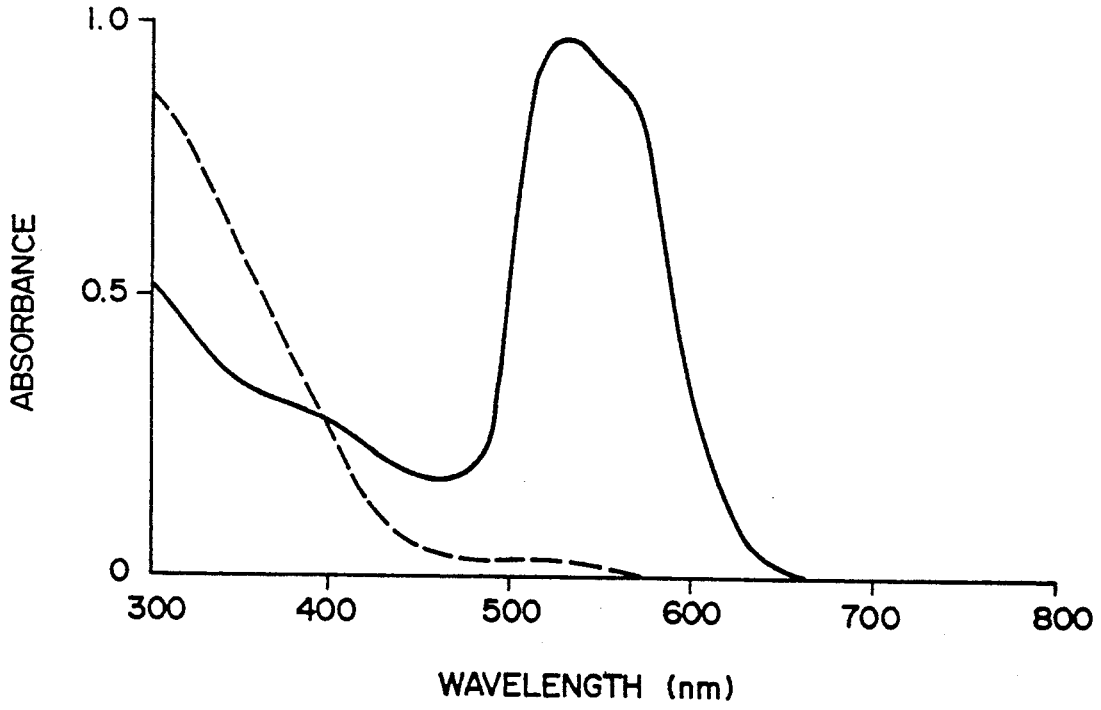
FIG. 2 shows absorption spectra of a dye layer used in the present invention.

Brilliant Carmine 6B (manufactured by Dainichi Seika Co.) was used as a dye and this was dispersed in a rosin-modified phenolic resin and a small amount of a petroleum solvent was added to the dispersion to prepare a printing ink. This was coated on a coated paper used for printing by the offset printing method to provide a dye layer as a film of a uniform thickness. In FIG. 2, absorption spectrum of this dye layer measured by the diffused reflection method is shown by solid line. There is a broad absorption at 500–600 nm and this shows so-called magenta color. Furthermore, it can be seen that there is no absorption of 700 nm or longer wavelength.

Figure 3:
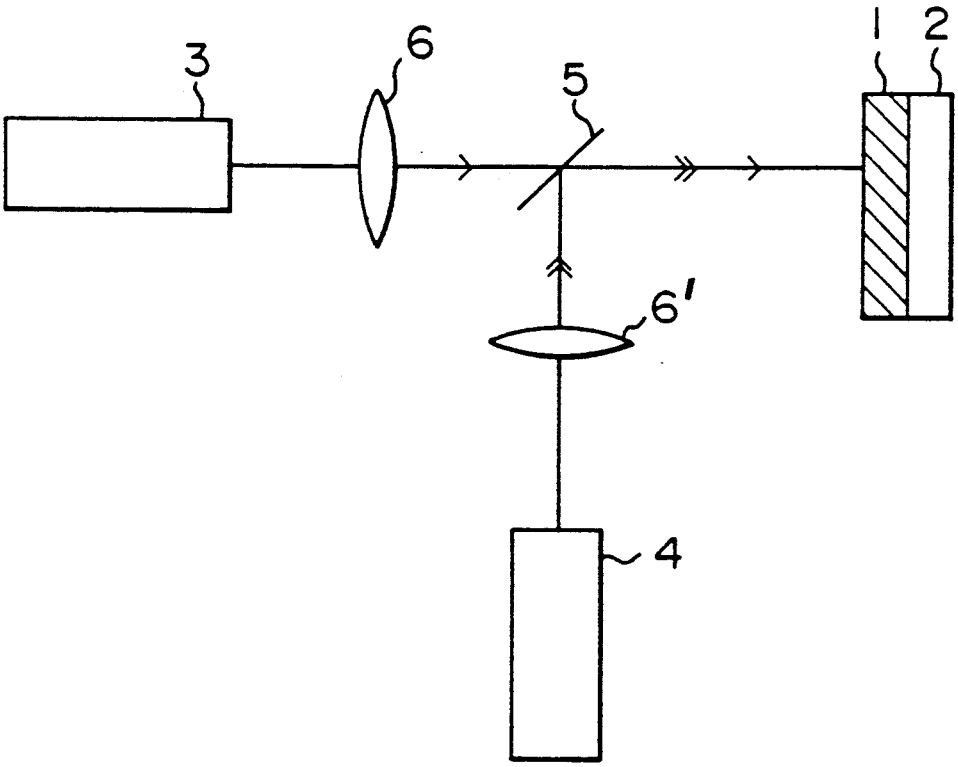
FIG. 3 shows a model of an optical system used for forming images according to the present invention, wherein 1 indicates a dye layer, 2 indicates a support, 3 indicates $Ar^+$ laser ($\lambda_1 = 514.5$ nm), 4 indicates a pulsed dye laser ($\lambda_2 = 725$ nm) pumped by an excimer laser (XeCl), 5 indicates a dichroic filter, and 6, 6' indicate condenser lenses.

This dye layer was irradiated with laser beam using the optical system shown in FIG. 3. This dye layer 1 was irradiated via a condenser lens 6 with an $Ar^+$ laser beam, first laser beam, emitted at 514.5 nm from an $Ar^+$ laser 3 close to the absorption maximum wavelength of the dye layer 1 at a beam power of 550 μW and a beam diameter of 100 μm as a continuous beam from the first laser ($Ar^+$ laser) 3. As the second laser beam, pulsed dye laser beam pumped by an excimer laser (XeCl) 4 which is emitted at 725 nm and irradiating dye layer 1 via a condenser lens 6' and dichroic filters. The second laser beam was not absorbed at all by the dye layer 1. Pulse repetition frequency of the second laser beam was 10 Hz, light energy per 1 pulse was 3.7 μJ, and pulse duration was 13 nsec. The diameter of the second laser beam was narrowed to the same beam diameter as that of the first laser beam, and was irradiated to the dye layer 1. When each laser beam was irradiated alone, no change was seen in absorption spectrum of the dye layer 1 even if irradiation of 100 sec (1000 pulses) was carried out. However, when the dye laser beam (second laser beam) was irradiated as a pulsed beam with while continuously irradiating the $Ar^+$ laser beam, the dye layer 1 was completely decolorized with about 160 pulses leaving only white color of the support 2. Observation of the portion irradiated with the laser beams under an optical microscope showed that the diameter of the decolorized spot was about 100 μm, which nearly corresponds to the diameter of the laser beams.

Furthermore, the area of about 1 cm × 1 cm of a dye layer was decolorized by moving the dye layer perpendicular to beam axis while simultaneously irradiating both the first and second laser beams, and the absorption spectrum of this area was measured. The results are shown as the dashed line in FIG. 2. As can be seen from FIG. 2, the absorption band at 500–600 nm which was originally present nearly disappeared and absorption at 400 nm or less increased.

The operation of irradiation the dye layer with the lasers mentioned above was carried out under roomlight.

As explained above, the present invention is an image formation method which utilizes decolorization of dye by irradiation with two kinds of laser beams and hence, the dye layer can be exposed to roomlight and sunlight at any time and no dark room was needed. Thus, handling of photosensitive materials is simple.

Furthermore, dye is decolorized only by irradiation with laser beams to form an image and so, after-treatment is not necessary at all and the high resolution possessed by laser beam can be utilized to the maximum.

What is claimed is:

1. A method for forming an image comprising the steps of:

providing a dye which absorbs a first laser beam at a first wavelength and does not absorb a second laser beam at a second wavelength; and simultaneously irradiating said dye with said first laser beam of said first wavelength and said second laser beam of said second wavelength to decolorize said dye; and wherein said dye can only be decolorized when said first laser beam of said first wavelength and said second laser beam of said second wavelength are applied to said dye simultaneously.

2. A method for forming an image as in claim 1, wherein said first laser beam of said first wavelength and said second laser beam at said second wavelength are supplied by first and second lasers respectively.

3. A method as in claim 2, wherein said first laser is an $Ar^+$ laser and said second laser is an excimer laser.

4. A method for forming an image on a dye which absorbs a first laser beam at a first wavelength and does not absorb a second laser beam at a second wavelength, wherein said dye can only be decolorized when said first laser beam of said first wavelength and said second laser beam of said second wavelength are applied to said dye simultaneously, said method comprising the step of simultaneously irradiating said dye with a laser beam of said first wavelength and a laser beam of said second wavelength to decolorize said dye.

5. A method for forming an image on a dye which absorbs a first laser beam at a first wavelength and does not absorb a second laser beam at a second wavelength, wherein said dye can only be decolorized when said first laser beam of said first wavelength and said second laser beam of said second wavelength are applied to said dye simultaneously, said method comprising the steps of:

continuously irradiating said dye with one of said first laser beam of said first wavelength and said second laser beam of said second wavelength; and irradiating said dye with the other one of said first laser beam of said first wavelength and said second laser beam of said second wavelength to decolorize said dye.

6. A method for forming an image as in claim 5, wherein said first laser beam of said first wavelength and said second laser beam of said second wavelength are supplied by first and second lasers respectively.

7. A method as in claim 6, wherein said first laser is an $Ar^+$ laser and said second laser is an excimer laser.

8. A method for forming an image comprising the steps of:

providing a dye which absorbs a first laser beam at a first wavelength and does not absorb a second laser beam at a second wavelength, said dye only being decolorized when said first laser beam of said first wavelength and said second laser beam of said second wavelength are applied to said dye simultaneously; and simultaneously irradiating said dye with said first laser beam of said first wavelength and said second laser beam of said second wavelength to decolorize said dye.

9. A method for forming an image as in claim 8, wherein said first laser beam of said first wavelength and said second laser beam of said second wavelength are supplied by first and second lasers respectively.

10. A method as in claim 9, wherein said first laser is an $Ar^+$ laser and said second laser is an excimer laser.

11. A method for image formation which comprises the step of irradiating a portion of a dye layer provided on a support simultaneously and coincidently with a first laser beam having a wavelength range which the dye layer absorbs and a second laser beam having a wavelength range which the dye layer does not absorb to decolorize the portion of the dye layer, wherein irradiating the dye layer with only one of the first and second laser beams does not cause decolorization of the dye layer.

* * * * *